United States Patent [19]

Cecil

[11] 4,040,126

[45] Aug. 9, 1977

[54] GOLF GLOVE

[76] Inventor: Leonard Cecil, 5644 Bent Branch Road, Bethesda, Md. 20016

[21] Appl. No.: 740,140

[22] Filed: Nov. 9, 1976

[51] Int. Cl.[2] ..... A41D 19/00

[52] U.S. Cl. ..... 2/161 A

[58] Field of Search ..... 2/321, 158, 159, 161 A, 2/162; 112/41, 419; 139/391; 66/194

[56] References Cited

U.S. PATENT DOCUMENTS

| | | | |
|---|---|---|---|
| 3,105,972 | 10/1963 | Christopher | 2/161 A |
| 3,274,616 | 9/1966 | Russo | 2/161 A |
| 3,372,401 | 3/1968 | Woodward | 2/159 |
| 3,501,774 | 3/1970 | Norman | 2/321 |
| 3,504,379 | 4/1970 | Glick | 2/161 A |
| 3,588,917 | 6/1971 | Antonious | 2/161 A |
| 3,600,715 | 8/1971 | Perrella | 2/162 |

*Primary Examiner*—G. V. Larkin

*Attorney, Agent, or Firm*—Brady, O'Boyle & Gates

[57] ABSTRACT

A golf glove having an improved fastener element extending transversely across the back portion thereof which includes a notch or slit type opening extending from the rear edge of the glove a predetermined distance toward the finger portion. The improvement comprises a single unitary stretch fastener element secured to the glove being adapted to be elastically stretched across the back of the glove and engage a complementary fastener element secured to the glove on the other side of the opening.

7 Claims, 4 Drawing Figures

GOLF GLOVE

BACKGROUND OF THE INVENTION

1. Field of the Invention

This invention relates generally to flexible gloves which are utilized to facilitate gripping of athletic equipment, and more particularly to a golf glove which is adapted to improve the snug fit of the glove on the hand of the wearer during the gripping of a golf club or the like.

2. Description of the Prior Art

Golf gloves utilizing various types of pile fasteners e.g. VELCRO, adapted to extend across the back portion of the hand are well known. The golf gloves, for example, disclosed in U.S. Pat. No. 3,952,333, issued to I. I. Fujita, illustrate various modifications of this type of glove. Other examples are shown in U.S. Pat. No. 3,588,917, A. J. Antonious and U.S. Pat. No. 3,504,379, F. L. Glick. And although stretch VELCRO material is known, what is common to these gloves and other state of the art gloves presently known to the applicant, is that while they include pile type or VELCRO fastener elements in various configurations, these elements are substantially rigid, i.e. being fabricated on rigid inelastic base fabric. As such, one of the fastener elements requires an additional element such as an intermediate elastic member between the glove and fastener or an elastic tape assembly must be sewn in a gathered fashion in the back portion adjacent the rigid fastener element in order to permit the wearer to adjustably engage an opposing complementary fastener element in order to hopefully obtain the degree of snugness desired. This requirement furthermore inherently complicates manufacture of the glove. It is to be noted also that while these arrangements work relatively well for a short time, the degree of comfort and snugness has limitations due to the additionally required supplemental elements such as the elastic members and tapes. These supplemental elements, moreover, are particularly subject to fatigue, resulting in the loss of the desired snugness of fit.

Accordingly, it is an object of the present invention to provide an improved golf glove which permits a wider range of adjustment without being subject to fatigue.

It is also an object of the present invention to provide a new and improved golf glove which is not only simpler in construction, but inherently provides a longer useful life as well as providing a product which is more pleasing to the eye.

SUMMARY

Briefly, the subject invention is directed to an improvement in gloves particularly adapted for athletic use, and one which includes a single unitary stretch fastener element secured to the glove body intermediate the rear edge of the glove and the finger portions thereof and being adapted to itself resiliently extend across a longitudinal opening in the back portion of the glove and engage a complementary fastening member secured to the back portion of the glove thereat on the other side of the longitudinal opening.

DESCRIPTION OF THE PREFERRED EMBODIMENT

Figure 1:
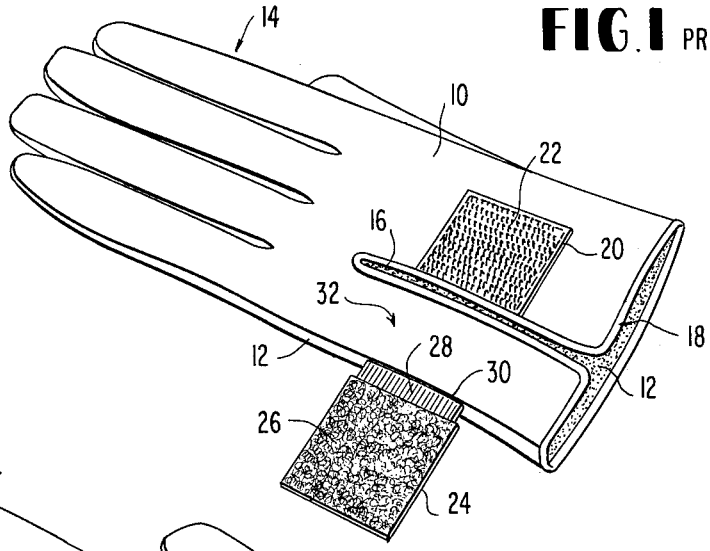
FIG. 1 PRIOR ART
FIG. 1 is a perspective view of a typical prior art glove using conventional pile type fastener means.

Referring first to FIG. 1, there is disclosed a typical prior art leather glove utilized for athletics or sports, e.g. golf, and having a back portion 10, a palm portion 12, and a finger portion 14. These portions are sewn or secured together in any desired manner so as to accommodate the hand of a wearer as comfortably as possible and in such a manner as to provide a "feel" for an article subsequently gripped, such as the shaft of a golf club or the like. The material, for example goat skin, from which the glove is constructed, moreover, is usually very thin and flexible and it becomes desirous to provide an extremely snug fit particularly along those surfaces which come in contact with the article being gripped. To this extent many types of fastener means and numerous structural designs have been resorted to in order to provide a sufficient degree of snugness, while at the same time providing comfort and the proper fit.

The type of golf glove shown in FIG. 1 has found wide appeal and includes a longitudinal opening 16 being provided in the back portion 10, extending from the rear edge 18 a predetermined distance toward the finger portion 14. Across the opening 16 fastener means are provided to selectively close the opening across the back of the hand in order to provide a proper degree of snugness and thus in turn causes the palm and back portions to fit tightly around the hand. The fastener means usually comprises pile fastener means of the VELCRO type wherein a multiplicity of tiny hook members are adapted to grip complementary tiny loop members with the respective hook and loop members being fabricated on rigid inelastic base fabric. More particularly, a member 20 comprised of inelastic base fabric including hook members 22 is sewn on the back portion 10 of the glove. The fabric member 20 extends generally transversely relative to the length of the opening 16. On the other side of the opening 16 a second fabric member 24 also comprised of inelastic base fabric including pile or loop material 26 formed thereon is attached to the glove by means of an elastic band type member 28 which is sewn for example along the outer longitudinal seam 30. Adjustability of the fit of the glove across the back of the hand of the wearer is accordingly provided by the stretching the elastic band member 28 attached to the inelastic fabric member 24 across the opening 16 to engage the hook containing fabric member 20. The reversal of the relative positions of the members 20 and 24 can be resorted to without seriously effecting its operation.

Figure 2:
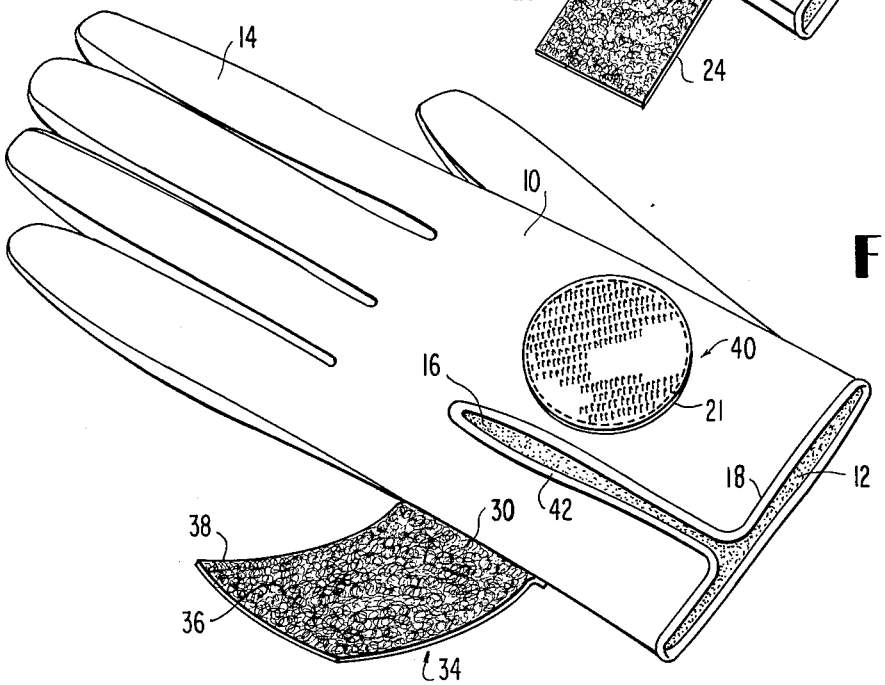
FIG. 2 is a perspective view of the preferred embodiment of the subject invention.
Figure 3:
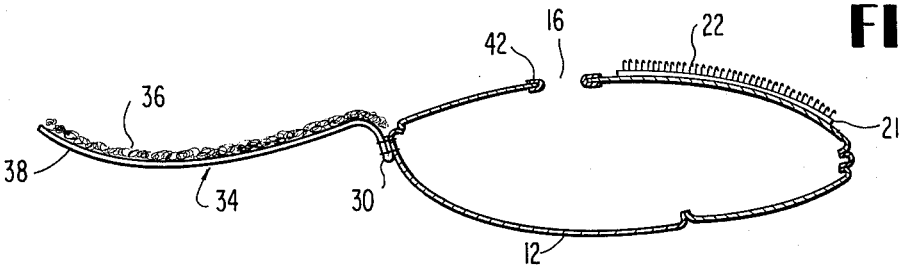
FIG. 3 is an end view of the glove shown in FIG. 2, being generally illustrative of the fastener means utilized in connection therewith.
Figure 4:
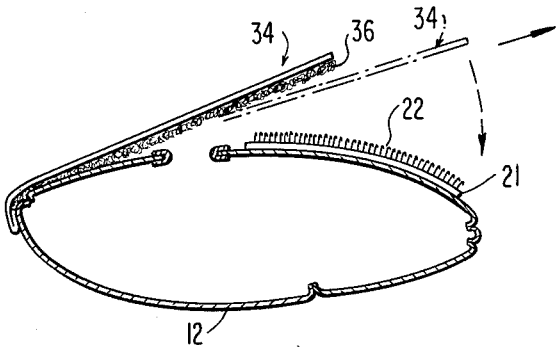
FIG. 4 is an end view of the glove shown in FIG. 2, being illustrative of the operation of the fastener means shown in FIG. 2.

Another embodiment of conventional prior art practice although not shown, additionally includes the same types of pile and hook fastener elements fabricated on inelastic fabric members as shown in FIG. 1 but consists of one in which for example the rigid fabric member 24 including the pile members 26 are not secured to the elastic member 28, but is sewn along the edge of the opening 16 directly across from the complementary fastener for example the member 20; however, the glove fabric in the region 32 (FIG. 1) is gathered and one or more elastic tapes are sewn therein. Such a configuration is moreover shown in FIGS. 2 and 3 of the referenced U.S. Pat. No. 3,952,333.

Referring now to the preferred embodiment of the subject invention, the glove shown therein additionally includes a back portion 10, a palm portion 12, and a finger portion 14. As in the prior art gloves, the embodiment of the subject invention includes a longitudinal cut or opening 16. It is at this point, however, that the subject invention departs from the prior art by removing the heretofore required elastic band 28 and/or elastic tapes sewn within the region 32 together with the rigid inelastic fastener members.

The present invention provides for a single unitary stretch fastener member 34 having first type pile material 36 e.g. loops or the like, formed on an elastic base fabric member 38 composed of, for example, two woven interlocking stretch components of tough synthetic fibers, typically 45% nylon and 55% elasterometric. The stretch fastener member 34 is sewn along the longitudinal seam 30 of the glove and is of a predetermined length to be stretched and drawn across the opening 16 to engage a complementary fastener member 40 having second type pile material, e.g. hooks or the like, formed on a base fabric member 21 which can be selectively either elastic or rigid. It should be noted, also, that reversal of the relative position of the first and second type pile material may be resorted to without departing from the spirit and scope of the invention. Also, the stretch fastener member 34 rather than being sewn adjacent the longitudinal seam 30 may be attached adjacently along the outer edge 42 of the opening 16.

Since the entire portion of the stretch fastener member 34 is elastic, a wider range of adjustment is provided, together with an even distribution of the pressure felt across the back of the hand of the wearer providing a degree of comfort and snugness of fit which has heretofore been unavailable. Additionally, with the use of stretch VELCRO material, the maximum stretch of the fastener member 34 is extended by at least 50% over prior art arrangements without being subject to fatigue with elastic recovery additionally being in the order of 98% immediately and substantially 100% after a few minutes. Since it is one of the prime objects that a glove of the type described maintain its conformity during any and all movement, e.g. swinging a golf club the single stretch fastener member 34 is adapted to out perform the conventional prior art gloves simply and economically, the latter being as a result of manufacturing being simplified by the elimination of heretofore required supplementary elastic members.

Having thus shown and described what is considered to be the preferred embodiment of the subject invention, I claim as my invention:

1. In a sports glove to facilitate the gripping of a golf club for example, a glove body including interconnected palm, finger and back portions, said back portion at least being comprised of substantially inelastic and non-resilient material such as leather and having a longitudinal opening extending forwardly from the rear edge of the back portion, the improvement comprising: a one piece integrally formed stretch fastener element attached to said glove body on one side of said opening and being in and of itself elastically extensible and stretchable across said opening, and a complementary fastener element fixed on said back portion on the other side of said opening and adapted to be engaged with said stretch fastener element with the latter elastically tensioned across said opening.

2. In a sports glove as defined in claim 1, and said stretch fastener element being attached at one end thereof to said glove body near one longitudinal side of the glove body.

3. In a sports glove as defined in claim 1, and wherein said stretch fastener element and said complementary fastener element each comprises a flexible pile type element for adherence to the other fastener element.

4. In a sports glove as defined in claim 3, and one of said pile type fastener elements includes a multiplicity of hooks and the other pile type fastener element includes a multiplicity of cooperating loops to interlock with the hooks when the two elements are pressed into engagement.

5. In a sports glove as defined by claim 1 wherein substantially all of said glove body is comprised of said substantially inelastic and non-resilient material.

6. In a sports glove, a glove body including a back portion comprised of substantially inextensible material such as leather and having a longitudinal opening extending forwardly from the rear edge of the back portion, a first flexible pile type fastener element fixed on said back portion on one side of said opening, and a cooperating integrally formed elastically extensible pile type fastener element attached at one end to said back portion on the other side of said opening, said cooperating elastically extensible pile type fastener element when stretched across said opening and engaged with said first pile type fastener element covering the major part of the back of the hand of a wearer of the glove between the wrist and knuckles and maintaining the glove in snug substantially wrinkle-free relation with the hand in the region between the wrist and knuckles.

7. In a sports glove as defined by claim 6 wherein said inextensible material comprises leather or leather substitutes.

* * * * *

UNITED STATES PATENT OFFICE

CERTIFICATE OF CORRECTION

Patent No. 4,040,126 Dated August 9, 1977

Inventor(s) Leonard Cecil

It is certified that error appears in the above-identified patent and that said Letters Patent are hereby corrected as shown below:

Title page, column 2, under the heading of: References Cited, United States Patents after 3,600,715 - 8/1971 - Perrella....2/162 add 3,943,981 - 3/1976 - De Brabander....139/391

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*